US012514373B2

(12) United States Patent
Simmons et al.

(10) Patent No.: US 12,514,373 B2
(45) Date of Patent: Jan. 6, 2026

(54) CHAIR WITH ACCESSORY HOLDER SYSTEM

(71) Applicant: Duelhawk Limited, London (GB)

(72) Inventors: Henry Simmons, Dubai (AE); Zeshan Walls, Dubai (AE)

(73) Assignee: Duelhawk Limited, London (GB)

( * ) Notice: Subject to any disclaimer, the term of this patent is extended or adjusted under 35 U.S.C. 154(b) by 207 days.

(21) Appl. No.: 18/446,862

(22) Filed: Aug. 9, 2023

(65) Prior Publication Data

US 2024/0122356 A1 Apr. 18, 2024

(30) Foreign Application Priority Data

Oct. 17, 2022 (GB) ..... 2215337

(51) Int. Cl.
*A47C 7/46* (2006.01)
*A47C 7/62* (2006.01)

(52) U.S. Cl.
CPC ..... *A47C 7/462* (2013.01); *A47C 7/622* (2018.08); *A47C 7/46* (2013.01); *A47C 7/62* (2013.01)

(58) Field of Classification Search
CPC .. A47C 7/46; A47C 7/462; A47C 7/62; A47C 7/622
USPC ..... 297/284.7
See application file for complete search history.

(56) References Cited

U.S. PATENT DOCUMENTS 1,236,517 A * 8/1917 Wemple et al. ..... A47B 39/02 297/284.7
1,264,265 A * 4/1918 Brusius ..... A47C 7/46 297/284.7
3,279,849 A * 10/1966 Radke ..... A47C 7/425 297/284.7 X
4,097,087 A * 6/1978 Garavaglia ..... A47C 7/46 297/284.7
4,161,337 A * 7/1979 Ross ..... B60N 2/66 297/284.7 X
4,362,334 A * 12/1982 Ross ..... A47C 7/405 297/284.7 X
4,711,492 A * 12/1987 Asbjornsen ..... A47C 7/405 297/284.7

(Continued)

FOREIGN PATENT DOCUMENTS

CN 104398031 A 3/2015
CN 215126293 U 12/2021

(Continued)

OTHER PUBLICATIONS

Intellectual Property Office Search Report of Application No. GB 2215337.3, mailed Apr. 14, 2023, 6 pages.

*Primary Examiner* — Rodney B White

(74) *Attorney, Agent, or Firm* — Womble Bond Dickinson (US) LLP

(57) ABSTRACT

A chair, comprising: a seat portion and a back portion, the back portion comprising: a front surface and a rear surface, a channel with an opening that extends in a length direction of the back portion on the front surface, and an accessory holder system, comprising: a rail that extends in the length direction of the back portion, an accessory holder disposed in the channel and slidably mounted on the rail, the accessory holder configured to hold a support accessory in position on the front surface, and a securing mechanism to releasably secure the accessory holder at different positions along the rail.

13 Claims, 17 Drawing Sheets

(56) References Cited

U.S. PATENT DOCUMENTS

| | | | | | |
|---|---|---|---|---|---|
| 4,730,871 | A * | 3/1988 | Sheldon | A47C 7/462 | 297/284.7 |
| 5,112,106 | A * | 5/1992 | Asbjornsen | A47C 7/46 | 297/284.7 |
| 5,791,733 | A * | 8/1998 | van Hekken | A47C 7/465 | 297/284.7 |
| 5,975,632 | A * | 11/1999 | Ginat | A47C 7/462 | 297/284.7 |
| 6,056,707 | A * | 5/2000 | Hayashi | A47C 7/46 | 601/102 |
| 6,059,362 | A * | 5/2000 | Lin | A47C 7/462 | 297/284.7 |
| 6,079,785 | A * | 6/2000 | Peterson | A47C 7/462 | 297/284.7 |
| 6,126,235 | A * | 10/2000 | Grove | A47C 7/425 | 297/284.7 |
| 6,260,921 | B1 * | 7/2001 | Chu | A47C 7/465 | 297/284.7 |
| 6,419,318 | B1 * | 7/2002 | Albright | A47C 7/462 | 297/284.7 |
| 6,575,530 | B1 * | 6/2003 | Fischer | A47C 7/462 | 297/284.7 |
| 6,848,744 | B1 * | 2/2005 | Raftery | A47C 31/02 | 297/284.7 |
| 6,981,743 | B2 * | 1/2006 | Edwards | A47C 7/402 | 297/284.7 |
| 7,234,773 | B2 * | 6/2007 | Raftery | A47C 7/462 | 297/284.4 |
| 10,272,282 | B2 * | 4/2019 | Harlow | A47C 7/746 | |
| 11,253,076 | B2 * | 2/2022 | Motley | A47C 7/44 | |
| 11,291,305 | B2 * | 4/2022 | Deevers | A47C 7/40 | |
| 11,583,092 | B2 * | 2/2023 | Deevers | A47C 7/44 | |
| 11,819,139 | B2 * | 11/2023 | Deevers | A47C 7/40 | |
| 12,004,660 | B2 * | 6/2024 | Deevers | A47C 7/46 | |
| 2002/0043841 | A1 * | 4/2002 | Giacinto | A47C 7/38 | 297/284.7 |
| 2002/0184832 | A1 * | 12/2002 | Reddig | A47C 9/06 | 52/36.5 |
| 2012/0306247 | A1 * | 12/2012 | Bisman | A47C 7/462 | 297/284.7 |
| 2019/0281988 | A1 * | 9/2019 | Su | A47C 7/46 | |
| 2022/0167748 | A1 * | 6/2022 | Motley | A47C 7/405 | |

FOREIGN PATENT DOCUMENTS

| | | | | | |
|---|---|---|---|---|---|
| CN | 216854215 | U | | 7/2022 | |
| CN | 217565399 | U | | 10/2022 | |
| GB | 2107576 | A | * | 5/1983 | A47C 7/462 |
| JP | 11196973 | A | * | 7/1999 | A47C 7/462 |
| KR | 101873721 | B1 | | 7/2018 | |
| KR | 1931432 | B1 | * | 3/2019 | A47C 7/62 |
| WO | WO-03051159 | A1 | * | 6/2003 | A47C 7/46 |

* cited by examiner

CHAIR WITH ACCESSORY HOLDER SYSTEM

CROSS-REFERENCE TO RELATED APPLICATIONS

This application claims the benefit of United Kingdom Patent Application No. 2215337.3, filed Oct. 17, 2022, at the United Kingdom Intellectual Property Office, the disclosure of which is incorporated herein by reference.

BACKGROUND

Field

Various embodiments herein relate to a chair with an accessory holder system.

Description of the Related Art

Chairs for office or gaming use often come with a support accessory such as, for example, a lumbar support or a neck support. It is desirable for the support accessory to be adjustable, so that each user may correctly position it. However, existing solutions for holding support accessories in an adjustable manner often compromise on aspects such as how securely they hold the support accessories in position once adjusted and/or how easily the support accessories may be adjusted. It is therefore desirable to provide an improved chair capable of holding a support accessory in a manner that is adjustable yet securely locked in position once adjusted and/or that allows the position of the support accessory to be easily adjusted.

SUMMARY

Various embodiments relate to a chair, comprising: a seat portion and a back portion, the back portion comprising: a front surface and a rear surface, a channel with an opening that extends in a length direction of the back portion on the front surface, and an accessory holder system, comprising: a rail that extends in the length direction of the back portion, an accessory holder disposed in the channel and slidably mounted on the rail, the accessory holder configured to hold a support accessory in position on the front surface, and a securing mechanism to releasably secure the accessory holder at different positions along the rail. The accessory holder, and, in turn, a support accessory held by the accessory holder, may be adjustable simply by sliding the accessory holder along the rail, yet securely locked in position once adjusted.

In various embodiments, the accessory holder system may be at least partially disposed between the front and rear surfaces of the back portion of the chair. For example, the rail and a main body of the slidable accessory holder may be disposed between the front and rear surfaces of the back portion of the chair. Such a configuration may help prevent fingers from being pinched or trapped by moving components of the accessory holder system. It may also protect the accessory holder system from damage.

In various embodiments, the channel may have another opening that extends in the length direction of the back portion on the rear surface. This may allow accessories to be attached at the rear of the chair, for example on the accessory holder or slotted into the channel using, for example, a hook, clip, or other attachment means.

In various embodiments, the accessory holder may include a support accessory holding element configured to pivot upwardly to cause the securing mechanism to release the accessory holder from a secured position on the rail. The support accessory may therefore be released from a secured position with ease from the front side of the chair, for example by lifting (upwardly rotating) a support accessory that is attached to the accessory holder in a direction away from the rail.

In various embodiments, the support accessory holding element may be biased towards the rail by a biasing element. The accessory holder may therefore be predisposed to return to a secured position, for example by letting go of a support accessory that is attached to the support accessory holding element.

In various embodiments, the securing mechanism may comprise a locking element connected to the accessory holding element, the locking element configured to selectively engage one of a plurality of complementary locking elements spaced apart along a length of the rail. A support accessory may therefore be secured at different height positions on the back portion of the chair.

In various embodiments, the accessory holder may include an indicator element configured to selectively engage one of a plurality of indicator elements spaced apart along the length of the rail, when the locking element of the accessory holder is in position to selectively engage one of the plurality of complementary locking elements on the rail. The positional relationship between indicator element(s) and locking element(s) may therefore allow a person to determine the positions along the rail at which the accessory holder may be secured.

In various embodiments, the indicator element of the accessory holder may be configured to produce an audible sound when engaging one of a plurality of indicator elements of the rail. The audible sound, for example a mechanical 'click' sound, may therefore provide positional cues to a person even when the indicator elements are not visible, for example when the accessory holder system is disposed between the front and rear surfaces of the back portion of the chair.

In various embodiments, the opening of the channel may extend along a length of a backrest of the back portion and/or extends along a length of a headrest of the back portion. The accessory holder system may therefore be used in conjunction with various kinds of support accessories, for example a back support accessory, a next support accessory, and/or a head support accessory.

In various embodiments, the channel may be located centrally in a width direction of the back portion. A support accessory held by the accessory holder may therefore provide support to the spine and neck of a person on the chair.

In various embodiments, the rail may be mounted on a base of the backrest. The base may therefore provide a stable supporting structure for the accessory holder system, while still allowing the relative movement between the back portion and the seat portion (e.g., tilting of the backrest).

In various embodiments, the rail may comprise a pair of rails, with the accessory holder slidably mounted between the rails. The pair of rails may provide a stable mounting structure for the accessory holder.

In various embodiments, the support accessory may comprise one or more of: lumbar support accessory, a neck support accessory, and a head support accessory.

In various embodiments, the accessory holder may include a rail guide member having wheels or rollers wheels or rollers spaced in the length direction of the back portion.

The rail guide member may therefore provide smooth movement of the accessory holder along the rail.

Various embodiments relate to an accessory holder system for a chair, comprising: a rail, an accessory holder slidably mounted on the rail and configured to hold a support accessory, and a securing mechanism to releasably secure the accessory holder at different positions along the rail.

Various embodiments relate to a chair, comprising: a seat portion and a back portion, the back portion comprising: a front surface and a rear surface, a channel with an opening on the rear surface that extends in a length direction of the back portion, and an accessory holder system, comprising: a rail that extends in the length direction of the back portion, an accessory holder disposed in the channel and slidably mounted on the rail, the accessory holder configured to hold an accessory in position on the rear surface, and a securing mechanism to releasably secure the accessory holder at different positions along the rail. The accessory may be a storage container, a clothes hook, etc. Such an accessory holder system may be of benefit where chairs are arranged one behind another.

Various embodiments relate to chair, comprising: a seat portion and a back portion, the back portion comprising: a front surface and a rear surface, a channel with a first opening on the front surface and a second opening on the rear surface, wherein the first and second openings extend in a length direction of the back portion, and an accessory holder system, comprising: a rail that extends in the length direction of the back portion, an accessory holder disposed in the channel and slidably mounted on the rail, the accessory holder configured to hold a support accessory in position on the front surface, and a securing mechanism to releasably secure the accessory holder at different positions along the rail.

BRIEF DESCRIPTION OF THE DRAWINGS

Reference will now be made to the accompanying drawings, which are not necessarily drawn to scale, and wherein.

DETAILED DESCRIPTION

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein.

It should be understood at the outset that although illustrative implementations of one or more aspects are illustrated below, the disclosed assemblies, systems, and devices may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

For purposes of description herein, the terms "front," "rear," "forward," "rearward," "upper," "lower," "length," "width," and derivatives thereof shall relate to embodiments as oriented/viewed in the figures. As used herein the term "parallel" means substantially parallel and includes out of parallel by an amount that does not adversely affect performance to a significant degree. It is to be understood that specific dimensions and other physical characteristics relating to the various embodiments disclosed herein are not to be considered as limiting, unless the claims expressly state otherwise. Various elements of the embodiments disclosed herein may be described as held by another element, which includes elements either directly or indirectly held by another element. Similarly, various elements of the embodiments disclosed herein may be described as attached to another element, which includes elements either directly or indirectly attached to another element. Furthermore, elements may be fixedly or removably held (e.g., swappable). Similarly, elements may be fixedly or removably attached.

While reference is made here to a chair for office or gaming use, the term "chair" is intended to cover other types of chairs/seating such as wheelchairs, pushchairs, vehicle seating, and the like. The term "support accessory" refers to any object that provides support to a person on the chair including, but not limited, a back support, a neck support, or a head support.

Figure 1:
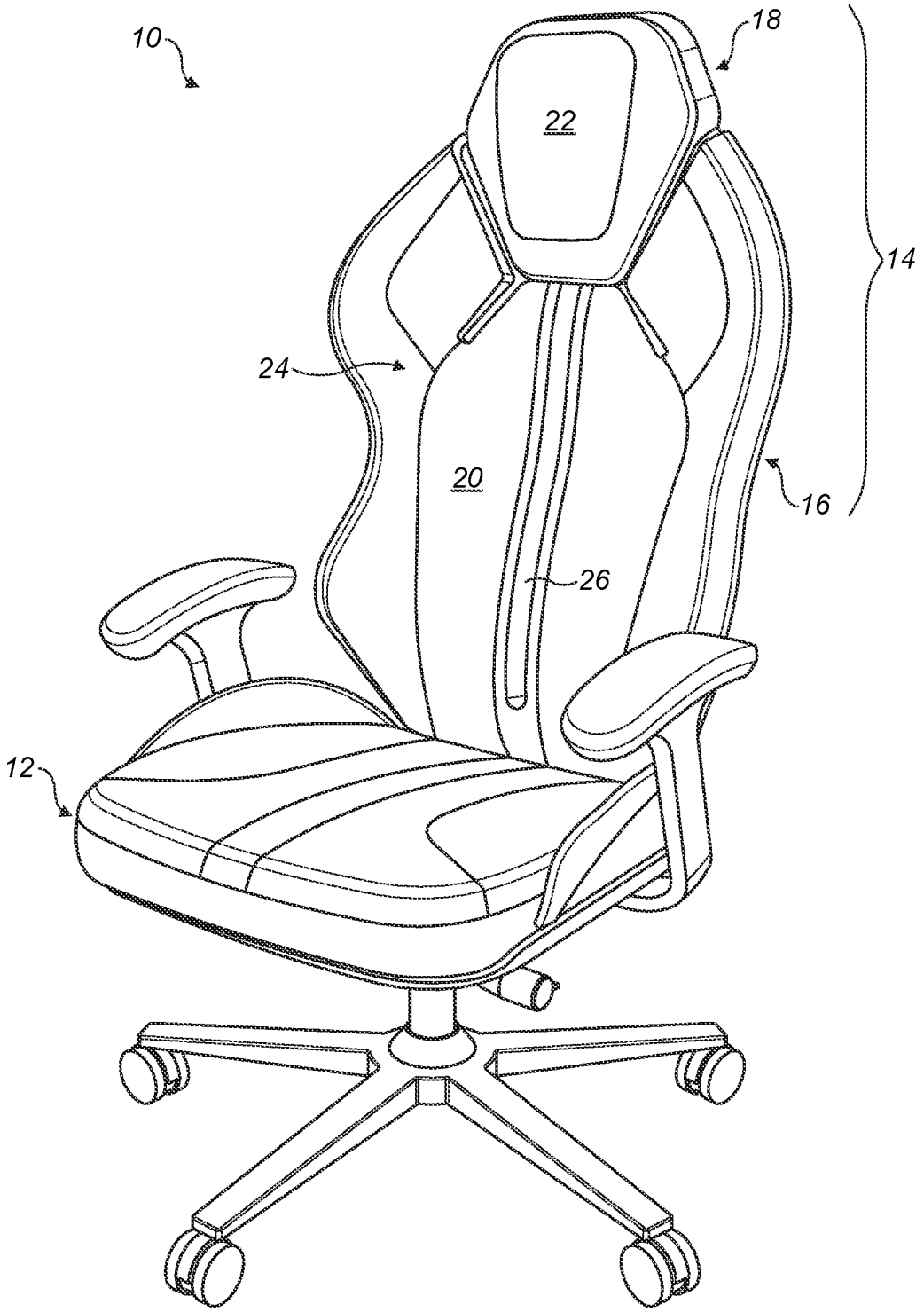
FIG. 1 illustrates a front perspective view of an exemplary chair in accordance with various embodiments described herein.
Figure 2:
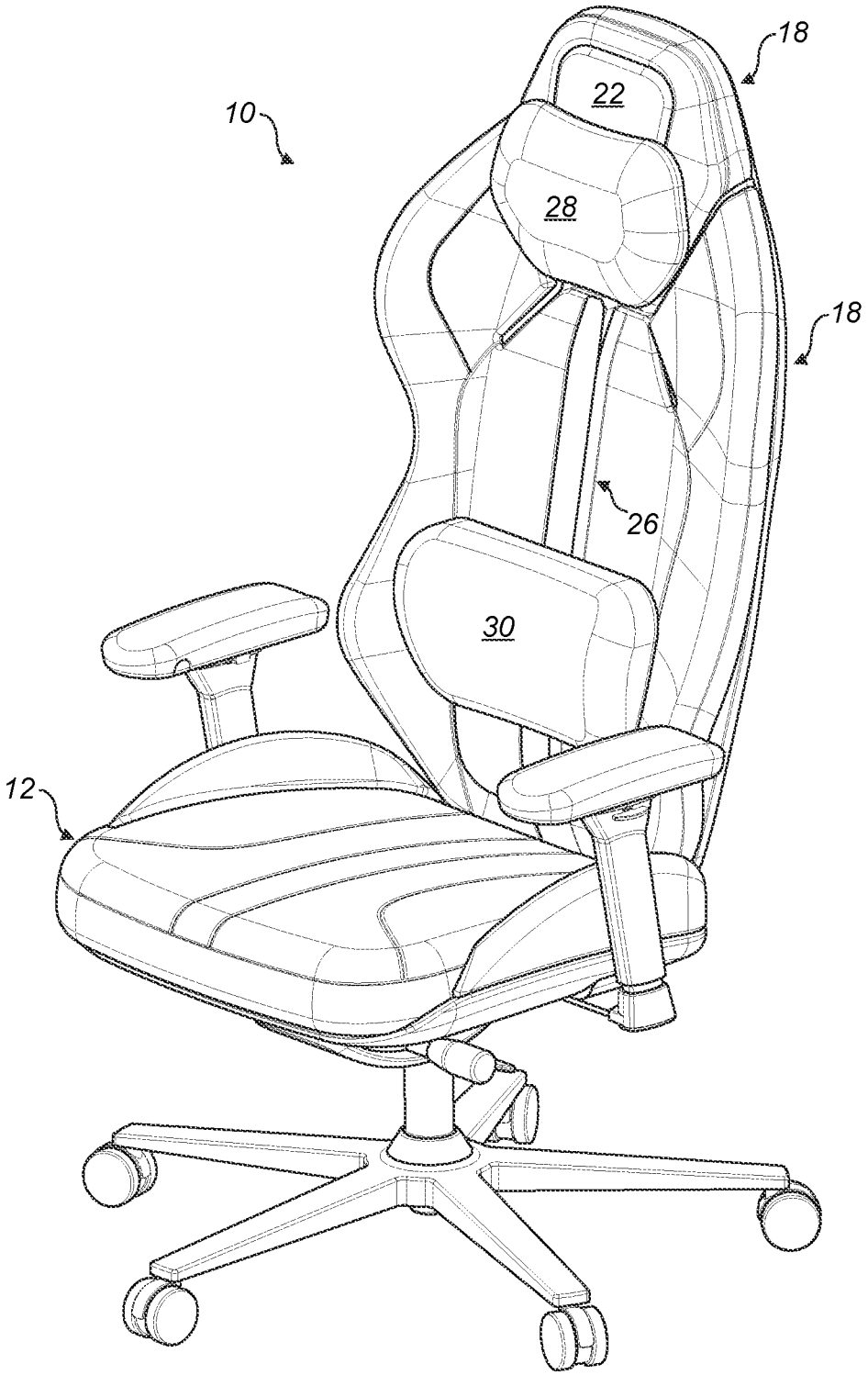
FIG. 2 illustrates a front perspective view of an exemplary chair in accordance with various embodiments described herein.

FIG. 1 illustrates a chair 10 according to various embodiments. The chair 10 may comprise a seat portion 12 and a back portion 14. The back portion 14 may comprise a front surface 24 (presenting an area directed towards a person on the chair 10) and a rear surface (not visible in the perspective view of FIG. 1) opposite the front surface 24. The front surface 24 may be upholstered or otherwise adapted to provide comfortable seating. A channel 26 with an opening may extend in a length direction of the back portion 14 on the front surface 24. The opening may have closed upper and lower ends. An accessory holder (not shown but described later with reference to FIGS. 8 to 15B) may be disposed in the channel 26 and may move along at least a portion of the length of the opening. The accessory holder may hold a support accessory that provides support to a person on the chair 10. The channel 26 may be formed centrally with respect to the width of the back portion 14, so that a support accessory held by the accessory holder may provide support to, for example, the spine, neck, or head of the person on the chair As shown in FIG. 1, the back portion 14 may comprise a backrest 16 and a headrest 18, each having a front surface 20, 22 and a rear surface (not visible in the perspective view of FIG. 1), and the opening of the channel 26 may be formed on the front surface 20 of the backrest 16 but not on the front surface 22 of the headrest 18. It will therefore be appreciated that in some embodiments the headrest 14 may be omitted from the chair 10 without affecting the proper functioning of the accessory holder. In other embodiments, as will be described below with reference to FIGS. 2 to 7, however, the opening of the channel 26 may be formed on the front surface 20 of the backrest 16 and on the front surface 22 of the headrest 18, for example as a continuous opening.

In various embodiments, the opening of the channel 26 may extend over the majority of the front surface 20 of the backrest 16, for example from a lower section adjacent to the seat portion 12 to an upper section adjacent to the headrest 18. This may permit a large range of movement of the accessory holder and may facilitate the use of different support accessories (e.g., swappable support accessories). In other embodiments, the opening of the channel 26 may extend over a shorter length. For example, the channel 26 may extend over just the lower section or over just the upper section. In other embodiments, a channel with an opening may be formed in the headrest 18 and not the backrest 16. Other embodiments may provide one or more channels with two or more openings, for example one channel with two openings (e.g., one opening on the upper section of the backrest and one opening on the lower section of the backrest, or one opening on the backrest and one opening on the headrest), or two channels each with one opening. Other combinations are, of course, possible.

The chair 10 may comprise other features such as, for example, armrests, side wings, a wheelbase, and casters. These will be familiar to the skilled reader and are therefore not described.

FIGS. 2 to 7 illustrate another chair 10 according to various embodiments. As noted above, the chair 10 illustrated in these figures differs from the chair 10 illustrated in FIG. 1 in that an opening of channel 26 may be formed on the front surface 20 of the backrest 16 and on the front surface 22 of the headrest 18. Otherwise, the features described above with reference to FIG. 1 are also present in the embodiments described below, and vice versa, to the extent that they are not inconsistent with one another. The width W and length L of the back portion 14 of the chair 10 are indicated for reference.

Figure 3:
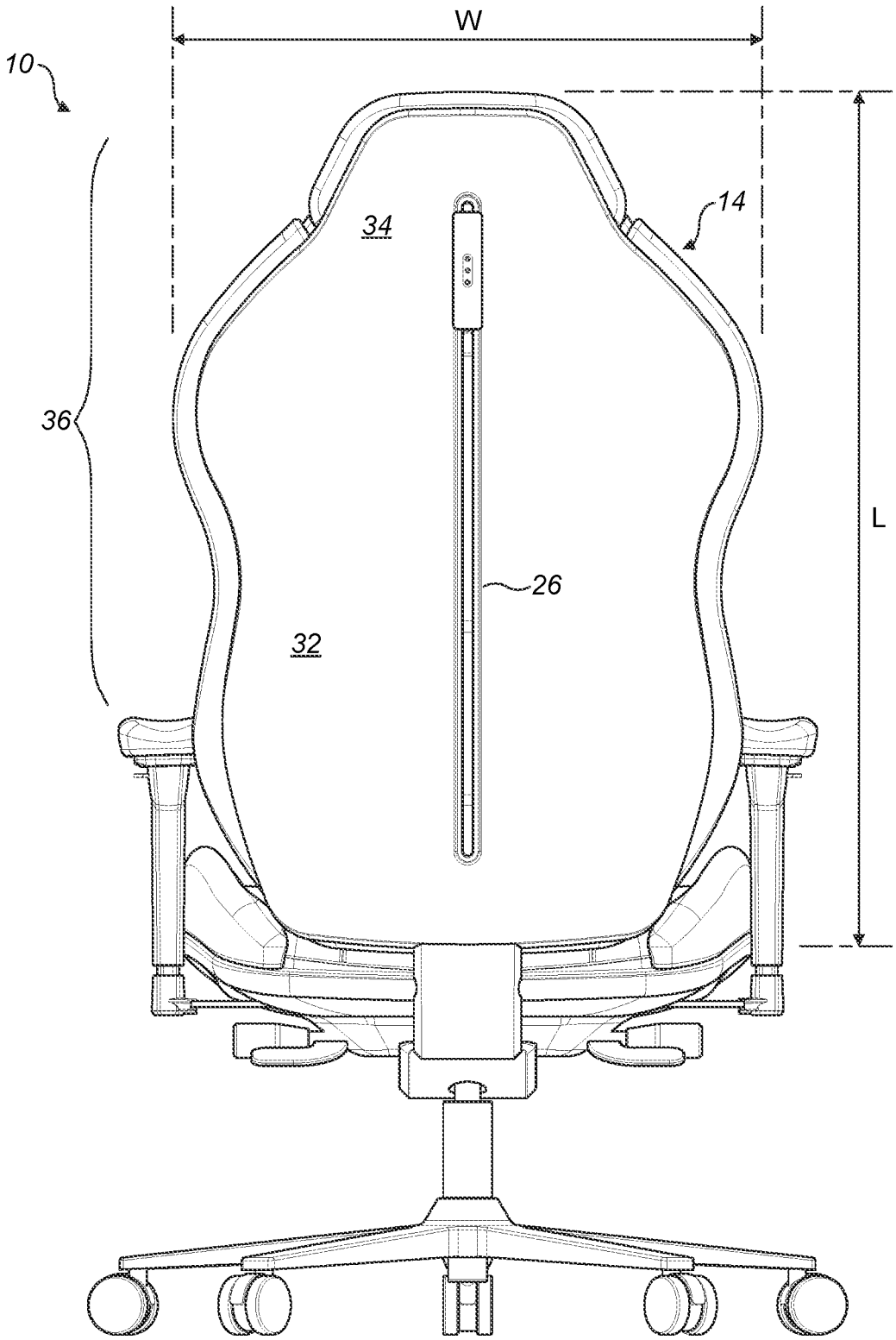
FIG. 3 illustrates a rear view of the chair illustrated in FIG. 2.
Figure 4:
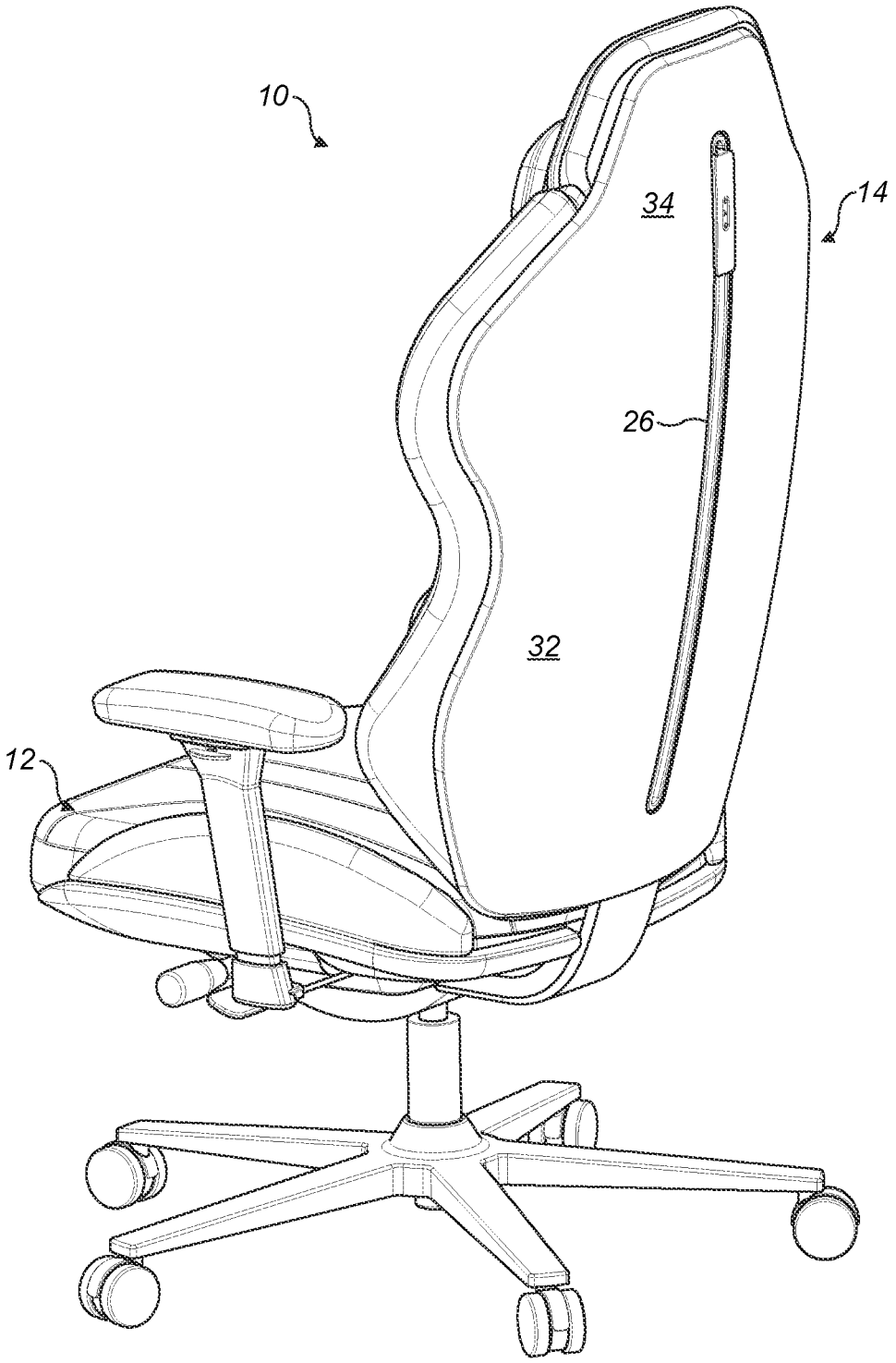
FIG. 4 illustrates a rear perspective view of the chair illustrated in FIG. 2.
Figure 5:
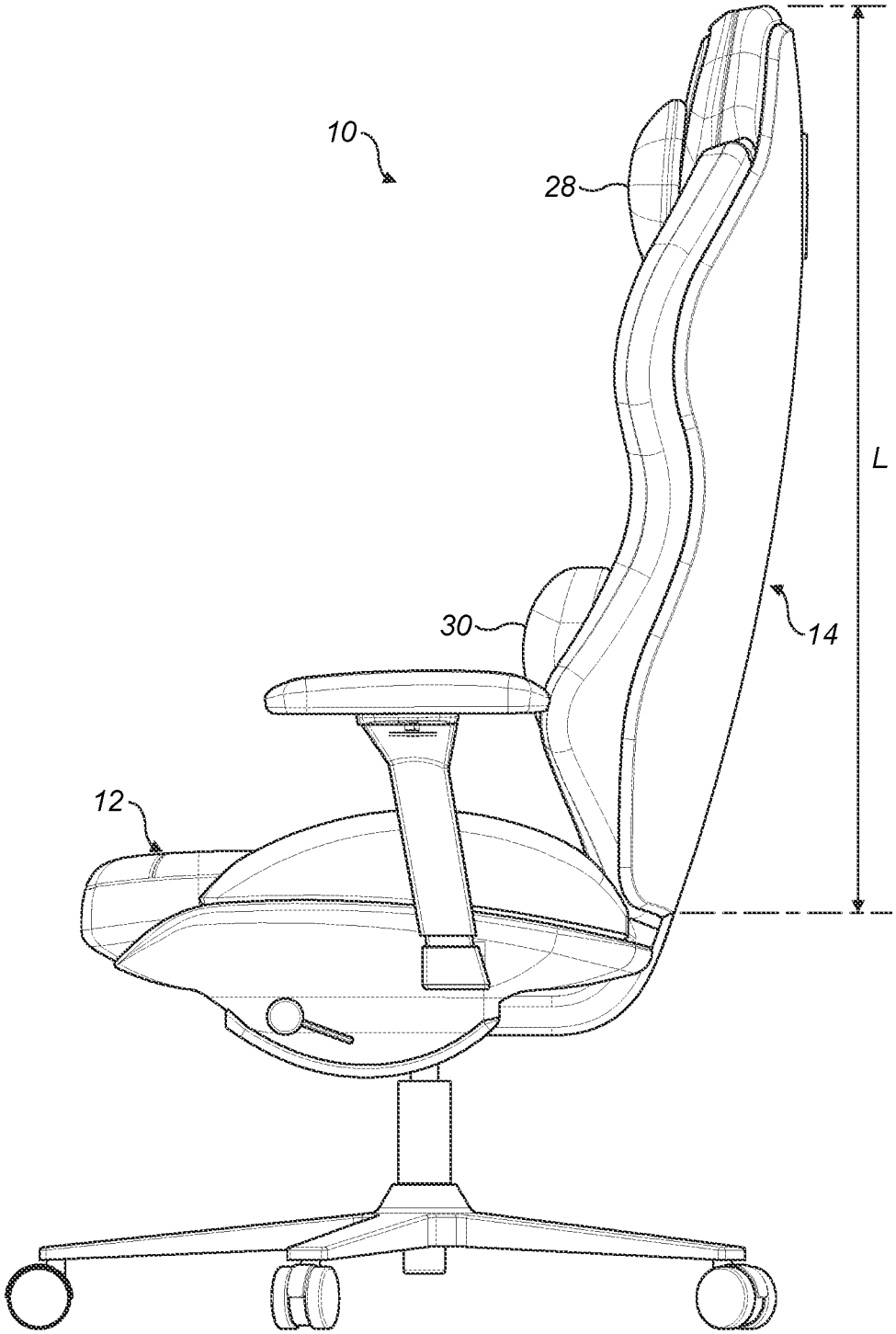
FIG. 5 illustrates a side view of the chair illustrated in FIG. 2.

As readily discernible from FIGS. 3 and 4, the channel 26 may have another opening extending in the length direction of the back portion 14 on a rear surface 36. Thus, the channel may pass through the entire thickness of the back portion 14. For example, the opening may extend on the rear surface 32 of the backrest 16 and on the rear surface 34 of the headrest 18, which may comprise a continuous surface as shown. That is to say, the backrest 16 and the headrest 18 may be integrally formed. However, alternatively, the backrest 16 and the headrest 18 may be formed as separate parts. The configuration (e.g., length and width) of the opening on the rear surface 36 may correspond to that of the opening on the front surface 24.

Referring now also to FIGS. 5 to 13, the back portion 14 of the chair 10 may include an accessory holder system 38. The accessory holder system 38 may comprise a pair of parallel rails 40, 42 that extend in a length direction of the back portion alongside or in the channel 26, an accessory holder 44 mounted on the rails 40, 42, and a securing mechanism 53 to releasably secure the accessory holder 44 at different positions along the rails 40, 42

Figure 6:
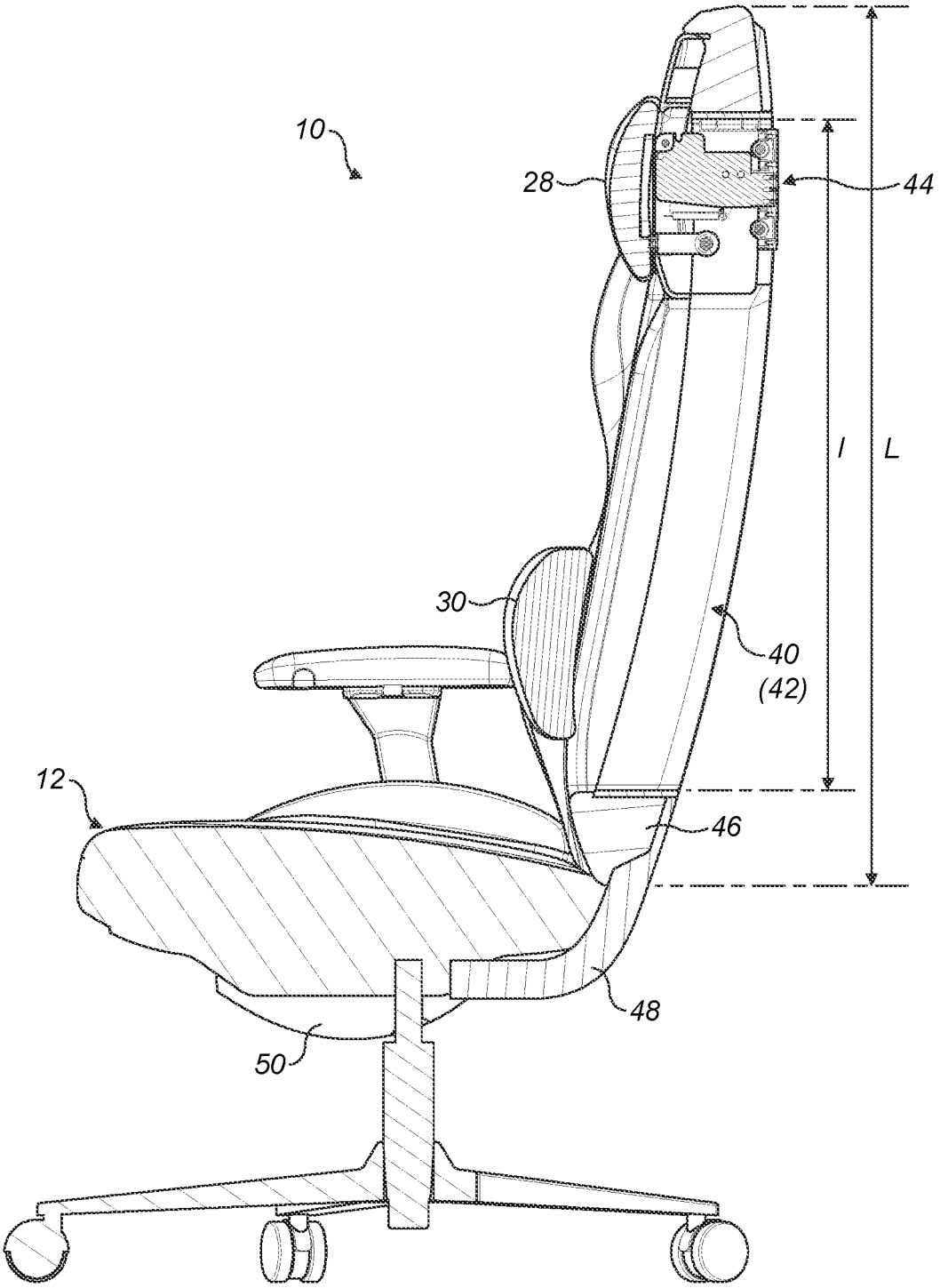
FIGS. 6 and 7 illustrate cross-sectional views of the chair illustrated in FIG. 2.
Figure 7:
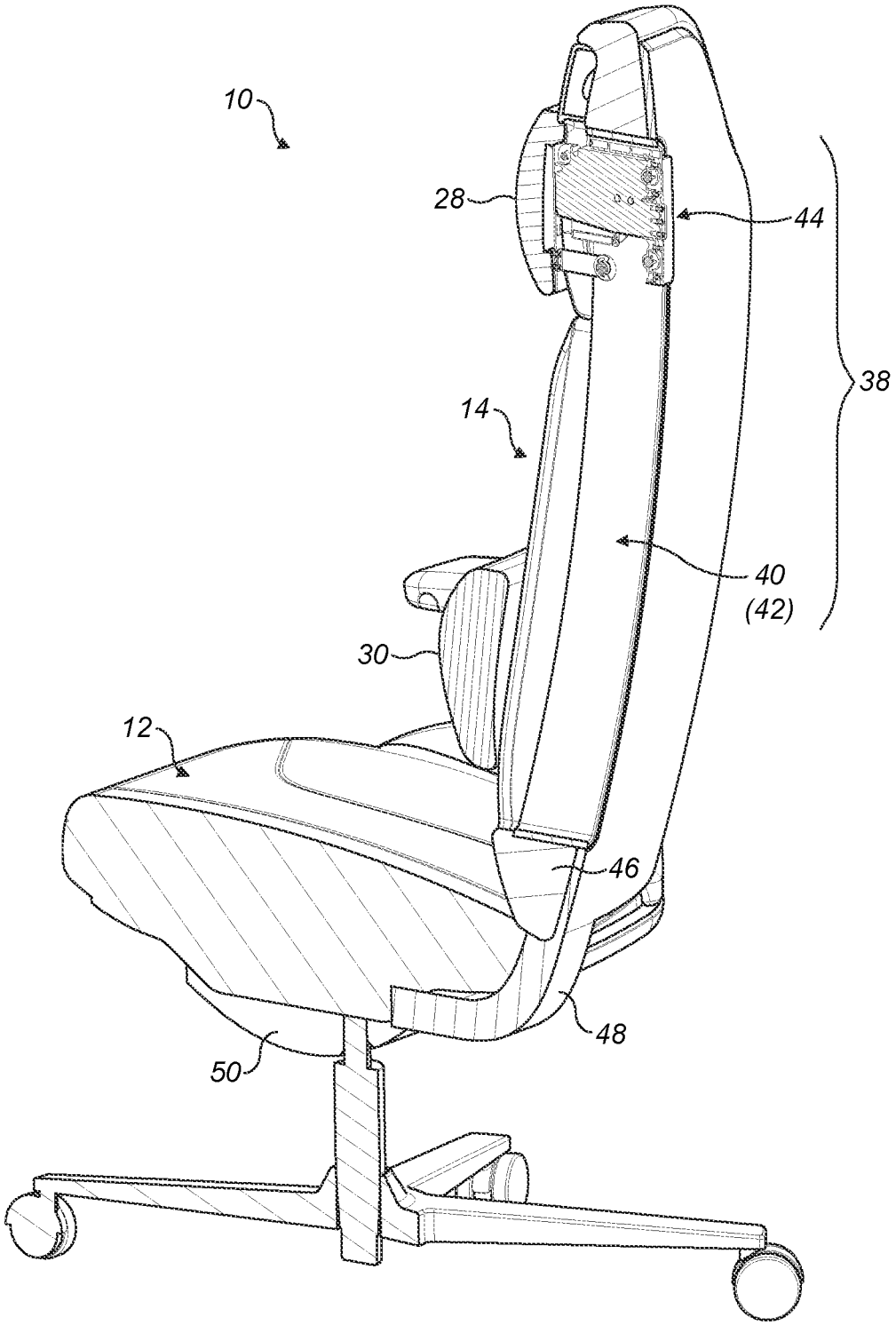

As can best be seen from FIGS. 6 and 7, at least part of the accessory holder 44 may be disposed in the channel 26, with the rails 40, 42 disposed in or on either side of the channel 26, between the front and rear surfaces 24, 36 of the back portion 14 of the chair 12. This may have not only aesthetic but also functional advantages such as protecting the accessory holder system 38 from damage or intrusion of objects such fingers that may be pinched or trapped by moving parts of the accessory holder system 38. The rails 40, 42 may be attached to a base 46 of the backrest 16 for stability and may be made of a hard-wearing and strong material such as but not limited to steel. A stem 48 may connect the base 46 of the backrest 16 to a base 50 of the chair 10 on which the seat portion 12 may be attached. The stem 48 may allow the backrest 16 to tilt relative to the seat portion 12.

In various embodiments, and as illustrated in FIGS. 8 to 14, the accessory holder 44 may be slidably mounted on rails 40, 42. The accessory holder 44 may comprise a main body 58 disposed between the rails 40, 42, a support accessory holding element 56 that is attached to main body 58 by a linkage member 64 on one side of the rails 40, 42 (adjacent to the opening on the front surface 24), and a rail guide member 68 on an opposite side of the rails 40, 42 to which the linkage member 64 and the support accessory holding element 56 are arranged.

The rail guide member 68 may comprise wheels or rollers that may engage the rails 40, 42 and that are spaced apart in the length direction on a wheel or roller support structure. The wheel or roller support structure may be provided with a cover that may slide along the opening on the rear surface 36 as can be best seen in FIGS. 3 and 4. A cap 70 (e.g., made of plastic) on the top of the rails 40, 42 may limit the upper movement of the accessory holder 44.

The support accessory holding element 56 may comprise a plate or other suitable interface to which a support accessory 28, 30 may be attached, and which may be configured to pivot upwardly about a pivoting axis defined by a pivoting mechanism 66 of the linkage member 64 that may be attached to an upper end of the support accessory holding element 56. The support accessory holding element 56 may be biased in an opposite direction to the pivoting direction by a biasing member 60 (e.g., a spring) that may be attached at one end to the main body 58 and at another end to the support accessory holding element 56 (e.g., to a hole 62 in the plate) below the pivot axis. (It is noted that the biasing member is shown in a detached state in FIGS. 8 to 14.) At a lower end of the support accessory holding element 56, opposite to the upper end where the pivot mechanism 66 is attached, there may be provided a locking element 52 that may be configured to selectively engage one of a plurality of complementary locking elements 54 on the rails 40, 42. Locking element 52 may be biased towards engagement with locking elements 54 by the biasing element 60. The locking elements 52, 54 may together define a securing mechanism 53 to releasably secure the accessory holder 44 at different positions along the rails 40, 42. In various embodiments, locking element 52 may comprise a pin and locking elements 54 may comprise rounded notches. The rounded nature of the notches may securely hold the pin, while still allowing the pin to be released easily and moved from one notch to the next.

In various embodiments, the rails 40, 42 may comprise a plurality of indicator elements 72 spaced apart along the longitudinal direction of the rails. The indicator elements 72 may comprise holes. An indicator element 74 on the main body 58 of the accessory holder 44, which may be a ball pin, may engage an indicator element 72 of the rail 40, 42. Although a pair of indicator elements 72 and pairs of indicator elements 74 are shown, fewer or greater numbers of indicator elements may be provided. The spacing between indicator elements 72 in the longitudinal direction of the rails 40, 42 may correspond to the spacing between locking elements 54 in the longitudinal direction of the rails 40, 42 (e.g., they may be aligned), with the indicator element 74 on the accessory holder 44 arranged relative to the locking element 52 on the accessory holder 44 so that the indicator element 74 engages an indicator element 72 on the rails 40, 42 when the locking element 52 of the accessory holder 44 is in position to engage a locking element 54 on the rails 40, 42. In embodiments, the indicator elements may provide an audible cue to the user such as, for example, a 'click' sound, whenever they engage with one another. This will be described further below in conjunction with the operation of the securing and pivoting mechanisms.

Figure 8:
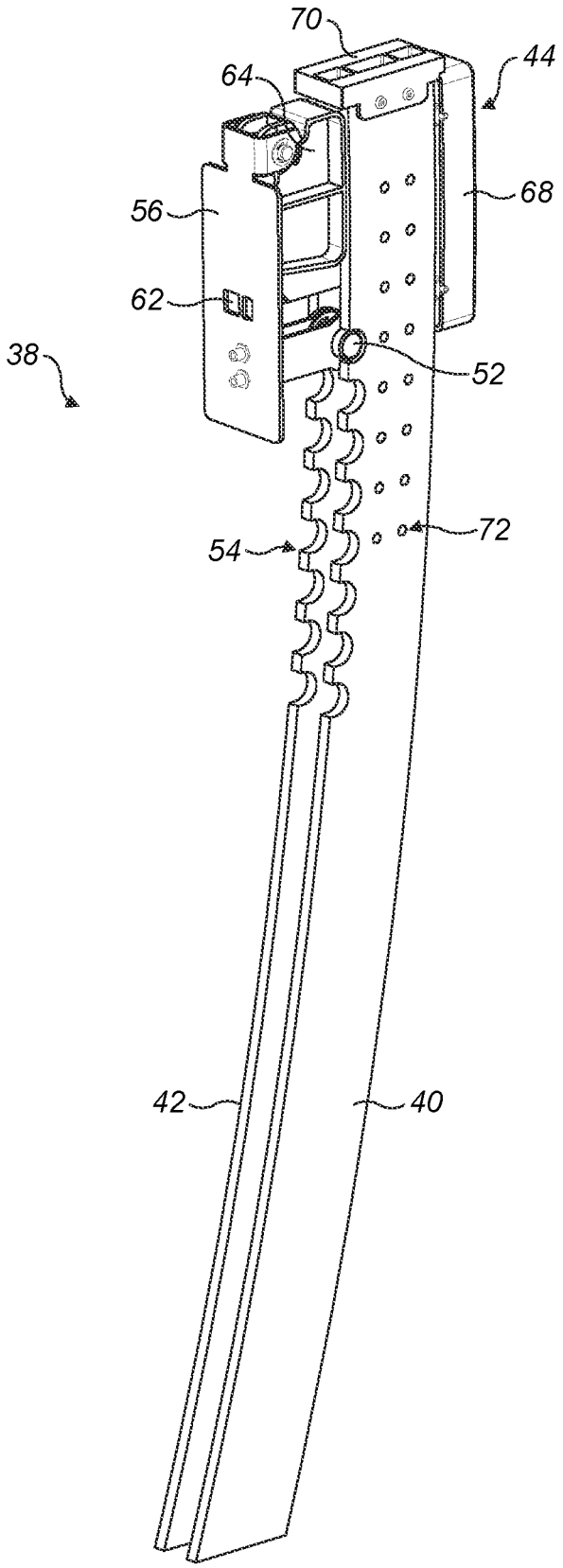
FIG. 8 illustrates a front perspective view of an exemplary accessory holder system in accordance with various embodiments described herein.
Figure 9:
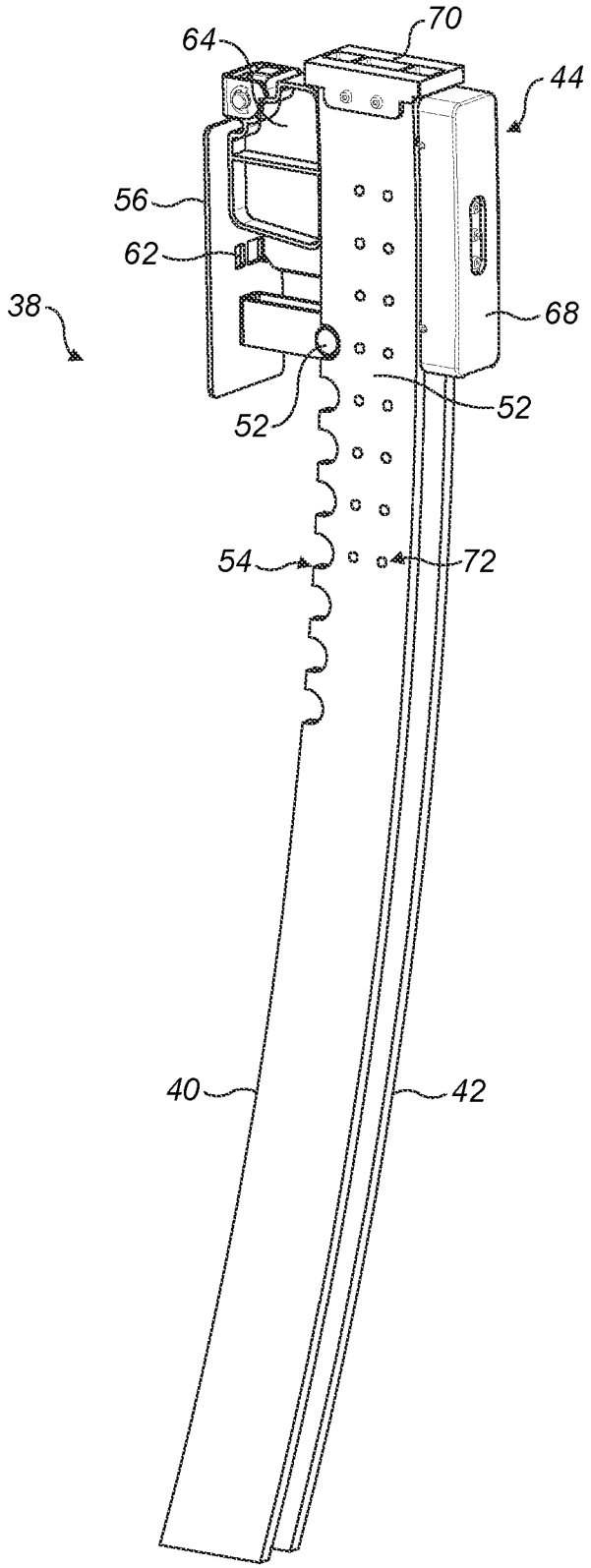
FIG. 9 illustrates a rear perspective view of the accessory holder system illustrated in FIG. 8.
Figure 10:
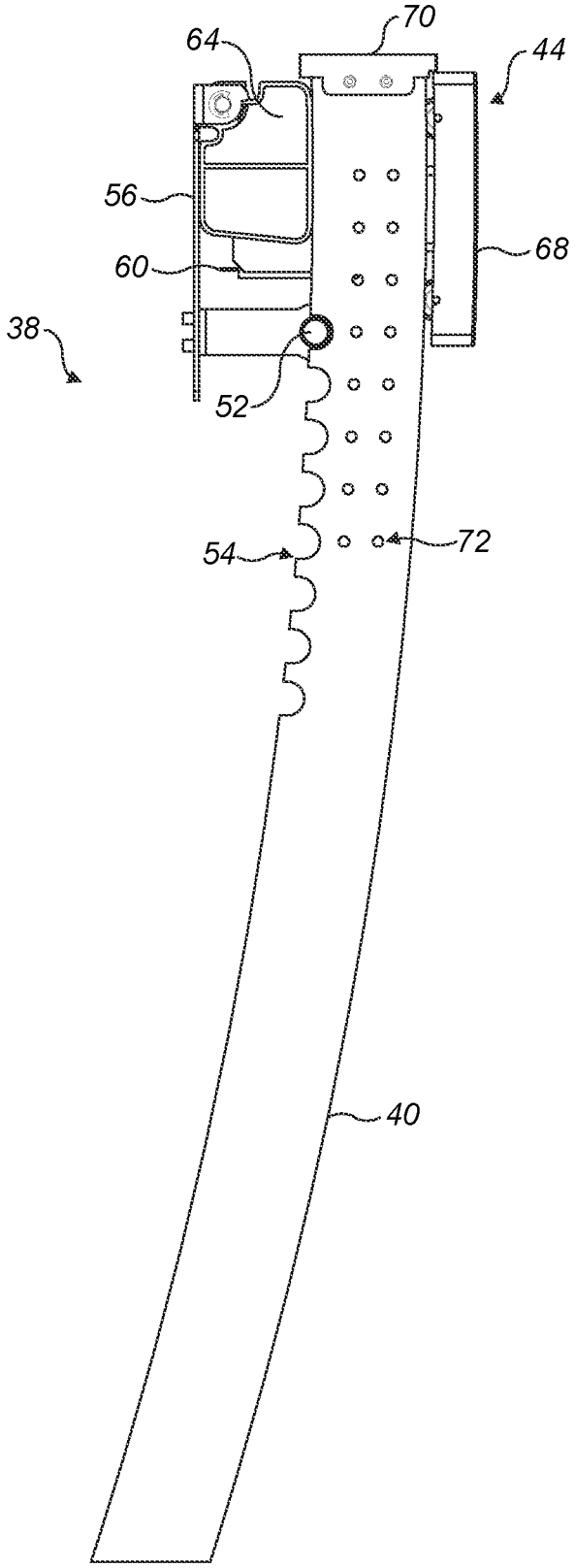
FIG. 10 illustrates a side view of the accessory holder system illustrated in FIG. 8.
Figure 11:
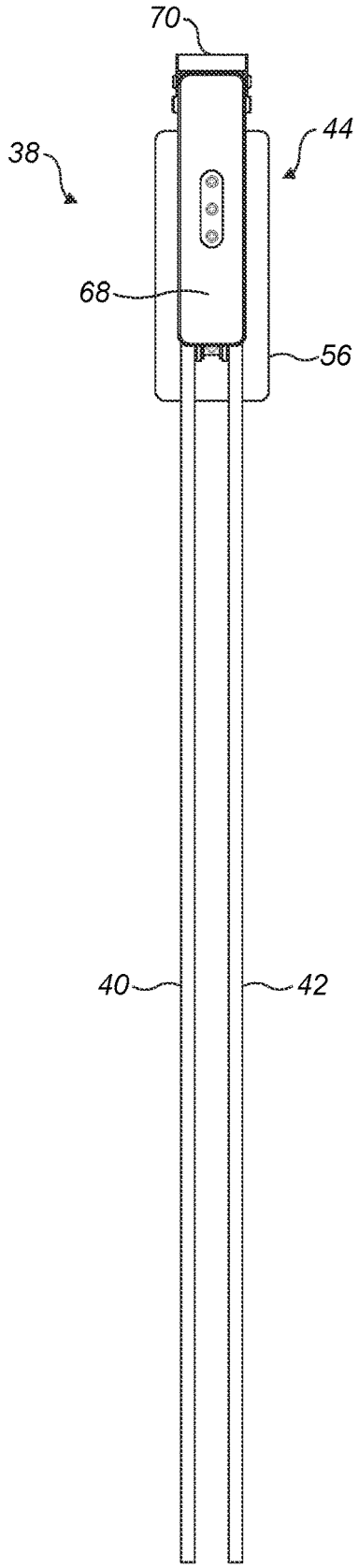
FIG. 11 illustrates a rear view of the accessory holder system illustrated in FIG. 8.
Figure 12:
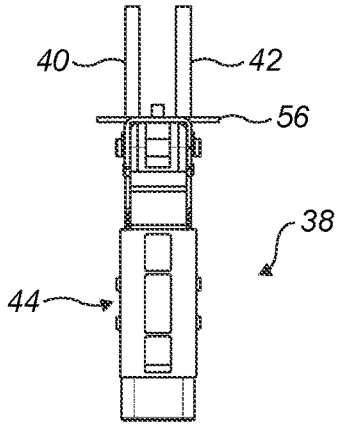
FIG. 12 illustrates a top view of the accessory holder system illustrated in FIG. 8.

In various embodiments, and as shown in FIGS. 8 to 10, the plurality of locking elements 54 on the rails 40, 42 may be spaced apart in the longitudinal direction of the rails 40, 42, in an upper region corresponding in position to the upper part of the backrest 16. When the locking element 52 on the accessory holder 44 engages the upper most locking element of the rails 40, 42, the support accessory holding element may be positioned at the headrest 18, as can be seen in FIGS. 6 and 7, and the support accessory 28 may be a headrest cushion. In these figures, the support accessory 30 (which may comprise a lumbar support cushion) is depicted to indicate how such a support accessory may be positioned if it replaces the support accessory 28 and if the accessory holder 44 has been slid to the bottom of the rails 40, 42 where the accessory holder 44 may rest on the base 46. In some embodiments, support accessories are swappable by a person using the chair. In other embodiments, multiple accessory holders may be mounted on the rails 40, 42 and may be movable independently from one another. It will be appreciated that the positions of the locking element of the rails 40, 42 may dictate the different positions along the rails 40, 42 at which the accessory holder 44 may be secured. Thus, in various embodiments, the rails 40, 42 may have locking elements 54 in a different region from that shown in FIGS. 8 to 10, e.g., in a lower region corresponding in position to the lower part of the backrest 16, or over substantially the entire length l of the rails 40, 42. The spacing of the locking elements 54 may be regular.

The operation of the securing and pivoting mechanisms will now be described with further reference to FIGS. 13 and 15B.

Figure 13:
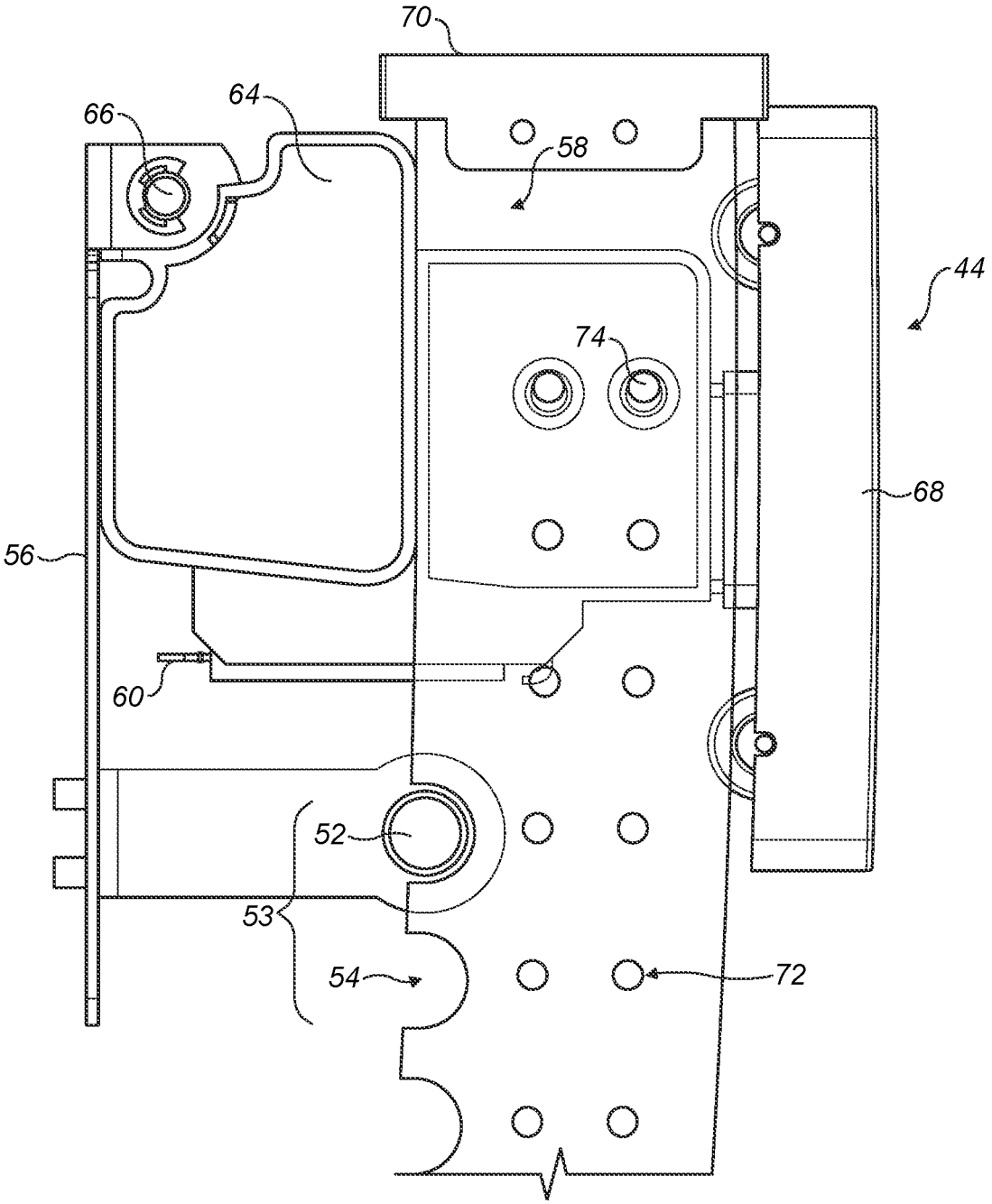
FIG. 13 illustrates a side view of accessory holder in accordance with various embodiments described herein.
Figure 14:
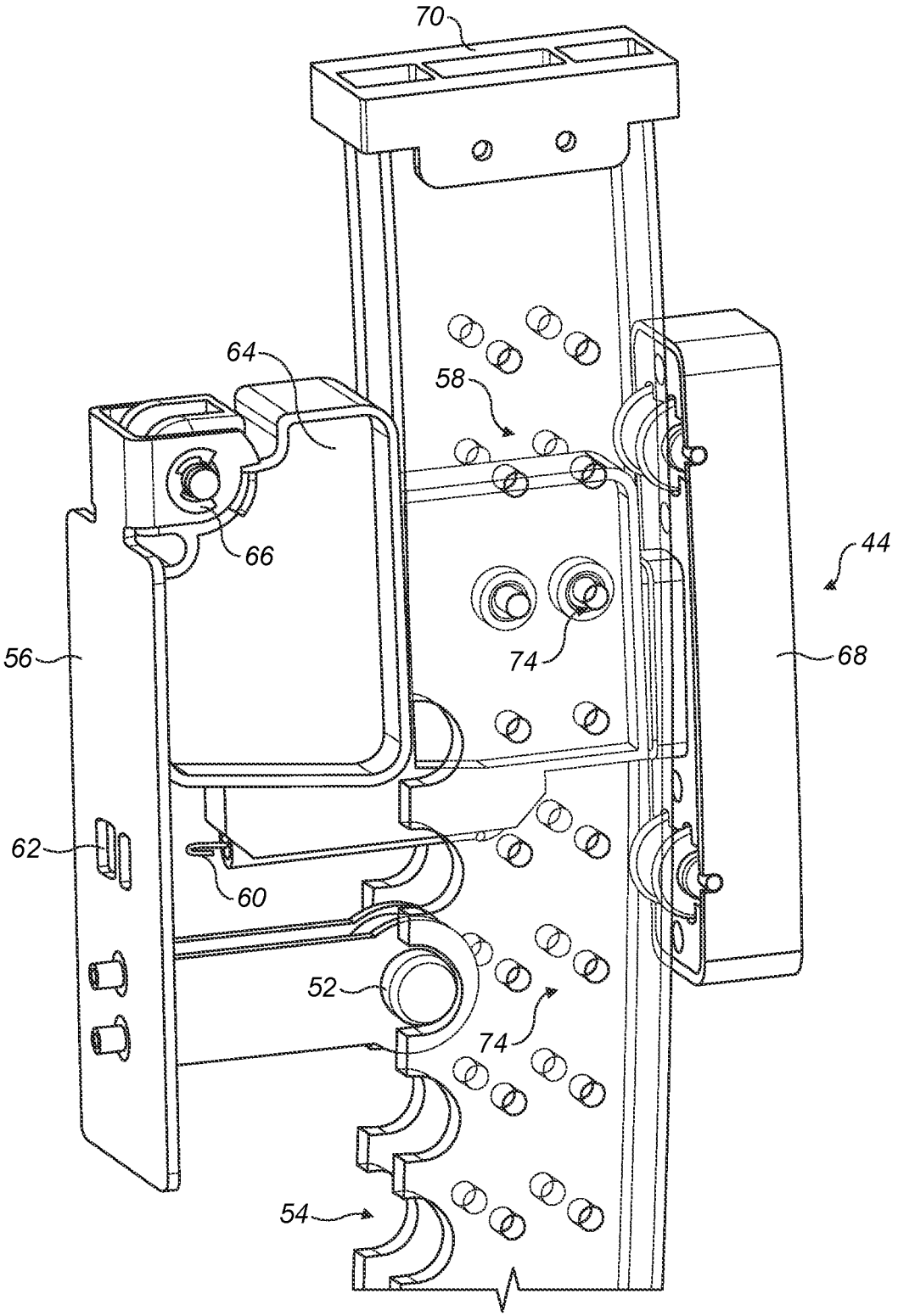
FIG. 14 illustrates a front perspective view of the accessory holder system illustrated in FIG. 13.

FIGS. 13 and 14 illustrate the accessory holder 44 in a secured position relative to the rails 40, 42. In this position, locking element 52 may engage one of the locking elements 54 on each of the rails 40, 42. The biasing element 60 (not shown attached) may apply a force on the support accessory holding element 56 in a direction toward the locking elements 54. Also in this position, indicator elements 74 on the main body 58 of the accessory holder 44 may selectively engage indicator elements 72 spaced apart on the rails 40, 42.

Figure 15A:
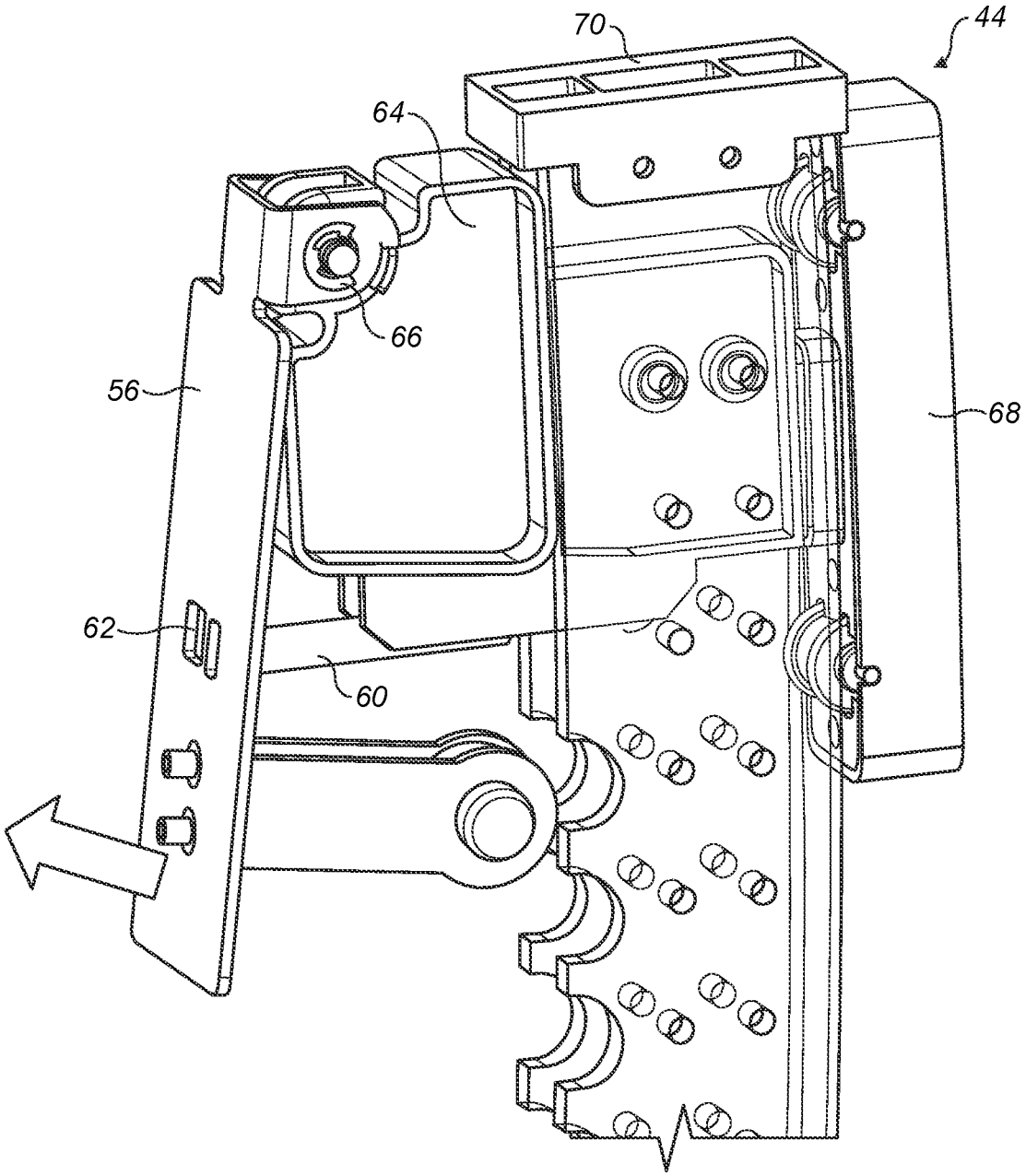
FIGS. 15A and 15B illustrate operation of an exemplary securing mechanism in accordance with various embodiments described herein.
Figure 15B:
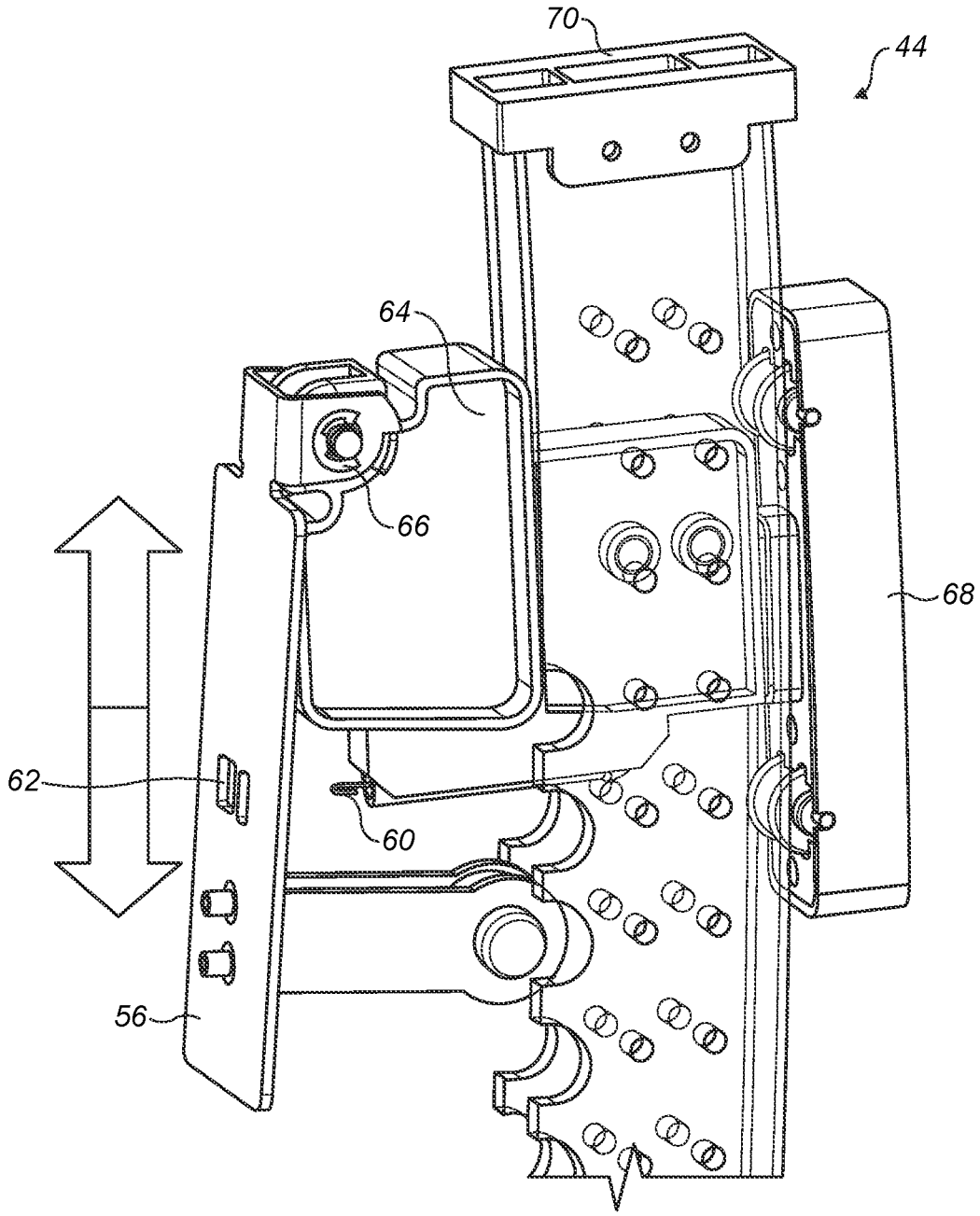

As shown in FIG. 15A, the accessory holder 44 may be released from a secured position by an upward pivoting movement of the support accessory holding element 56. This may be due to a force applied on the support accessory that is being held by the support accessory holding element 56. If this force is sufficient to overcome the force acting on the support accessory holding element 56 in the opposite direction applied by the biasing element 60, the locking element 52 may disengage from locking element 54 sufficiently to allow movement. At the same time, the indicator element 74 on the accessory holder 44 may disengage from the indicator element 72 on the rails 40, 42. The accessory holder 44 may then be held in a pivoted position and moved along the rail as shown in FIG. 15B. At a point in this movement, the indicator element 74 on the accessory holder 44 may engage another indicator element 72 on the rails 40, 42. An audible sound such as a mechanical click may be generated to provide an indication that locking element 52 is in the correct position to engage another locking element 54. The user may let go of the support accessory and the accessory the lock pin mays once again engage a notch on each of the rails 40, 42.

Figure 16:
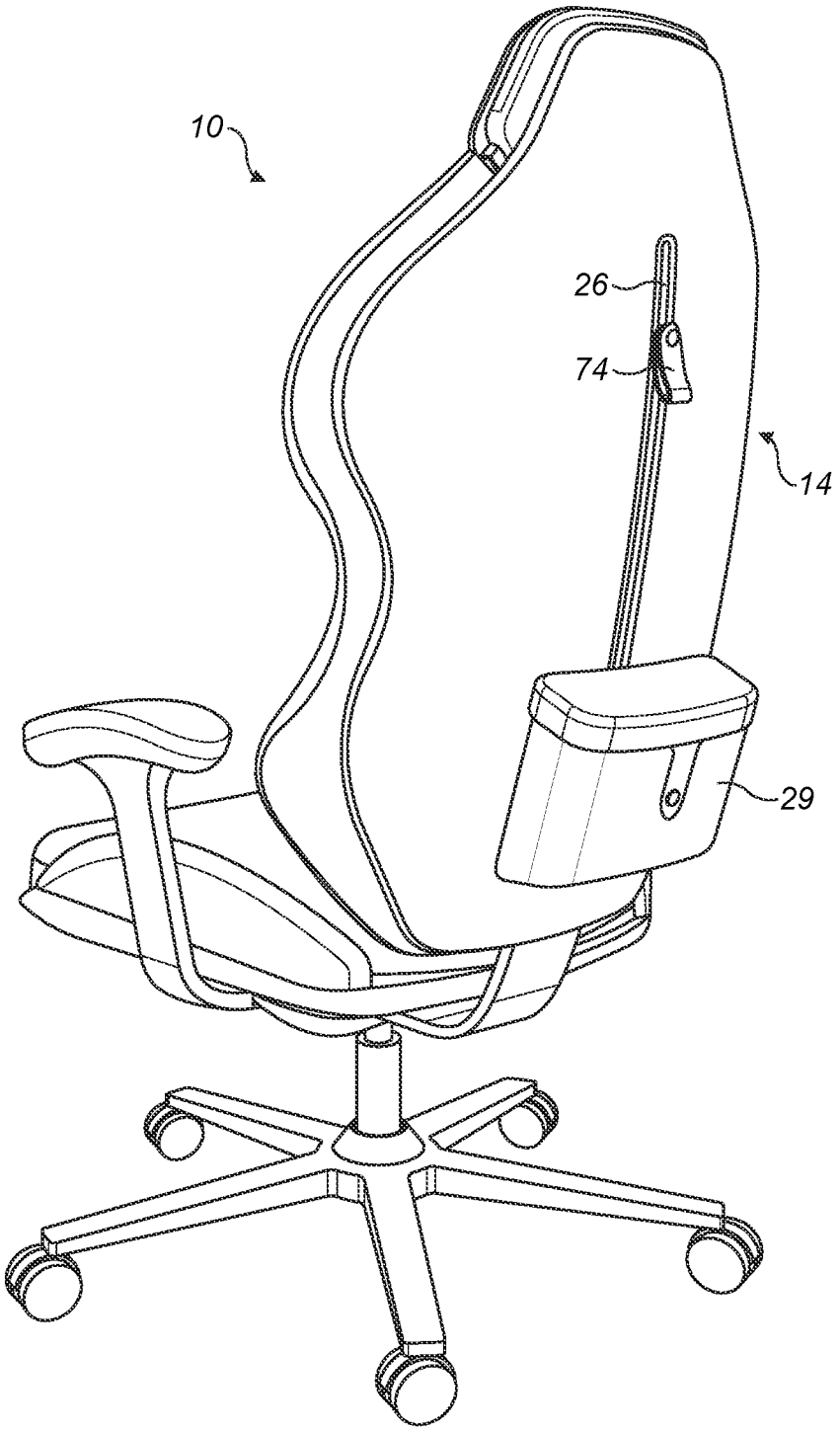
FIG. 16 illustrates a rear perspective view of another exemplary in accordance with various embodiments described herein.
Figure 17:
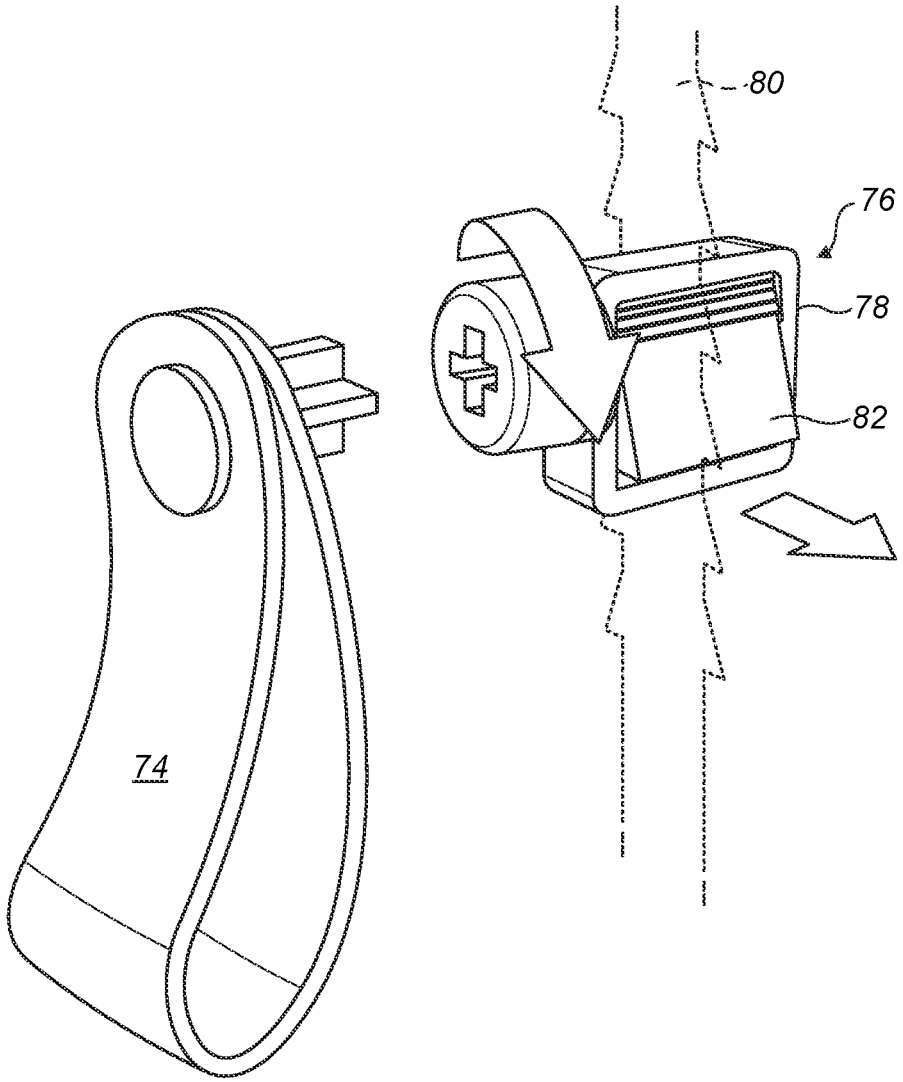
FIG. 17 illustrates another exemplary securing mechanism in accordance with various embodiments described herein

Many modifications, variations, and alternatives are possible. For example, as shown in FIGS. 16 and 17, an alternative securing mechanism to releasably secure an accessory holder at different positions may comprise a linear ratchet mechanism 76. The linear ratchet mechanism 76 may comprise a toothed rack 80 extending in a length direction of the chair back 14, and a slidable element 78 that may be connected to an accessory holder (not shown). The slidable element 78 may be slidably mounted on the toothed rack 80 for movement in upward and downward directions. Within a cavity of the slidable element 78, one or more wedge shaped pawls 82 may be positioned and may be biased towards engagement with toothed rack 80. The pawls 82 and toothed rack 80 may allow the slidable element 78 to slide upwards freely and have a blocking effect in the downwards direction. The pawls 82 may be disengaged from the toothed rack 80 by a force acting in a direction that is opposite to the biasing force on the pawls 82. As shown in these figures, the pawls 82 may be actuated from a rear of the chair, for example by rotation of a release tab 74 that may be provided on the rear surface of the back portion 14, but in other implementations a modified accessory holder as described with reference to FIGS. 13 and 14 may be implemented. Furthermore, it is possible that the pawls 82 may be activated from the front of chair 10, for example based on a modified version of the accessory holder described with reference to FIGS. 13 and 14. It will be apparent that, if a securing mechanism may be actuated from the rear of the chair 10, no channel need be provided on the front of the chair. In such implementations, the accessory may be, for example, a storage container, tray, clothes hook, etc.

Other securing mechanisms that may be implemented in various embodiments include, for example, a quick release cam lock, screw knob, and a magnetic securing mechanism. For example, a magnetic securing mechanism may be released by a pivoting movement which acts in a direction opposite to a magnetic force exerted by a magnet of the accessory holder on a rail including magnets of opposite polarity or made of a magnetic material such as steel.

A single rail may be provided instead of a pair of rails. In such an implementation, the accessory holder, e.g., the main body of the accessory holder, may at least partially surround the rail instead of being arranged between the rails. Furthermore, the rail or rails may be provided externally, for example on the rear surface of the back portion.

Indicator elements that produce an audible sound may be supplemented or replaced by visual indicator elements. For example, markings such as coloured lines or similar graphical highlighting may be provided on the front and/or rear surfaces of the back portion.

Many other modifications, variations, and alternatives will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

For convenience of the reader, a list of the reference numerals used in the figures and description is provided below.

10 chair
12 seat portion
14 back portion
16 backrest
18 headrest
20 front surface of the backrest
22 front surface of the headrest
24 front surface of the back portion
26 channel
28 30 support accessory
29 accessory
32 rear surface of the backrest
34 rear surface of the headrest
36 rear surface of the back portion
38 accessory holder system
40, 42 rails
44 accessory holder
46 base of the back portion
48 stem
50 base of the chair
52 locking element of the accessory holder
53 securing mechanism
54 locking element of the rails
56 support accessory holding element
58 main body
60 biasing element
62 attachment point
64 linkage member
66 pivoting mechanism
68 rail guide member
70 cap
72 indicator elements of the rails
74 indicator elements of the accessory holder
74 tab
76 alternative securing mechanism
78 slidable element
80 toothed rack
82 pawl

What is claimed is:

1. A chair, comprising:
a seat portion and a back portion, the back portion comprising:
a front surface and a rear surface,
a channel with an opening that extends in a length direction of the back portion on the front surface, and
an accessory holder system, comprising:
a rail that extends in the length direction of the back portion,
an accessory holder disposed in the channel and slidably mounted on the rail, the accessory holder configured to hold a support accessory in position on the front surface, and
a securing mechanism to releasably secure the accessory holder at different positions along the rail;
wherein the accessory holder includes a support accessory holding element configured to pivot upwardly to cause the securing mechanism to release the accessory holder from a secured position on the rail.

2. The chair of claim 1, wherein the accessory holder system is at least partially disposed between the front and rear surfaces of the back portion of the chair.

3. The chair of claim 2, wherein the channel has another opening that extends in the length direction of the back portion on the rear surface.

4. The chair of claim 1, wherein the support accessory holding element is biased towards the rail by a biasing element.

5. The chair of claim 1, wherein the securing mechanism comprises a locking element connected to the accessory holding element, the locking element configured to selectively engage one of a plurality of complementary locking elements spaced apart along a length of the rail.

6. The chair of claim 5, wherein the accessory holder includes an indicator element configured to selectively engage one of a plurality of indicator elements spaced apart along the length of the rail, when the locking element of the accessory holder is in position to selectively engage one of the plurality of complementary locking elements on the rail.

7. The chair of claim 6, wherein the indicator element of the accessory holder is configured to produce an audible sound when engaging one of a plurality of indicator elements of the rail.

8. The chair of claim 1, wherein the opening of the channel extends along a length of a backrest of the back portion and/or extends along a length of a headrest of the back portion.

9. The chair of claim 1, wherein the channel is located centrally in a width direction of the back portion.

10. The chair of claim 1, wherein the rail is mounted on a base of the backrest.

11. The chair of claim 1, wherein the rail comprises a pair of rails, with the accessory holder slidably mounted between the rails.

12. The chair of claim 1, wherein the support accessory comprises one or more of: lumbar support accessory, a neck support accessory, and a head support accessory.

13. The chair of claim 1, wherein the accessory holder includes a rail guide member having wheels or rollers spaced in the length direction of the back portion.

* * * * *